US005111959A

United States Patent [19]

Glickman

[11] Patent Number: 5,111,959

[45] Date of Patent: May 12, 1992

[54] INJECTION MOLDED FOLLOW BLOCK FOR FILE DRAWER

[75] Inventor: Joel I. Glickman, Hungtingdon Valley, Pa.

[73] Assignee: Magic Mold Corporation, Hatfield, Pa.

[21] Appl. No.: 597,888

[22] Filed: Oct. 15, 1990

[51] Int. Cl.[5] ..... B65D 57/00

[52] U.S. Cl. ..... 220/544

[58] Field of Search ..... 220/544, 528, 545, 546, 220/547, 548, 529, 532

[56] References Cited

U.S. PATENT DOCUMENTS

| | | | |
|---|---|---|---|
| 1,037,912 | 9/1912 | Howard . | |
| 1,061,463 | 5/1913 | Fraser . | |
| 2,110,185 | 3/1938 | Weesies | 129/27 |
| 2,271,678 | 3/1942 | Burdick | 129/31 |
| 2,746,457 | 5/1956 | Musacchia | 129/30 |
| 4,081,100 | 3/1978 | Presby | 220/22.4 |
| 4,102,470 | 7/1978 | Timmons | 220/22.3 |
| 4,703,982 | 11/1987 | Rock et al. | 312/330 R |
| 4,735,324 | 4/1988 | Wilcek | 220/544 |
| 4,770,714 | 9/1988 | Giesler | 220/544 |

*Primary Examiner*—Joseph Man-Fu Moy
*Attorney, Agent, or Firm*—Schweitzer Cornman & Gross

[57] ABSTRACT

An injection molded plastic follow block for installation in a pre-assembled file drawer having spaced-apart vertical sidewalls with longitudinally extending, recessed guide channels extending lengthwise. The molded follow block incorporates integral, longitudinally extending guide bars of elastically deflectable construction enabling the follow block to be installed in the drawer after assembly and painting thereof. Significant manufacturing economies are realized.

10 Claims, 3 Drawing Sheets

11
16
17
20
24
25
26
27
33
34
35
36
37
38
5

INJECTION MOLDED FOLLOW BLOCK FOR FILE DRAWER

BACKGROUND AND SUMMARY OF THE INVENTION

The present invention relates to the construction of file drawers, for example of the type commonly used for organizing and retaining file folders in an orderly fashion. In a typical file drawer construction, provision is made for an adjustable follow block, in the form of a plate or panel which extends transversely across the drawer cavity, between the sidewalls of the drawer and is adjustable longitudinally. The arrangement is such that the working space provided for the retention of files or other papers can be readily adjusted to the number of files or documents to be stored, enabling the files to be retained in a more or less vertical orientation.

Although there are a wide variety of constructions of follow block arrangements, one of the widely used constructions involves the provision of longitudinally extending guide channels formed in sheet metal panels constituting the opposite sidewall members of the file drawer. The follow block panel is provided at opposite sides with longitudinally extending guide bars, which are received in and guided and confined by the longitudinally extending guide channels. The opposed guide channels may typically be provided with a series of uniformly spaced openings in their lower walls, arranged to receive downwardly projecting lugs on the guide bars, in order to accommodate adjustable positioning of the follow block at various discrete locations along the length of the file drawer.

In the file drawer construction described above, and to which this invention is directed, it is intended that the follow block be permanently assembled with the file drawer by reason of the confinement of the guide bars within the longitudinally extending guide channels formed in the spaced sidewalls of the drawer. In drawers of conventional construction, this arrangement has led to certain complications in the manufacture of the drawer assemblies, resulting in increased manufacturing cost in the first instance, and perhaps more significantly, a relatively high rate of rejection of the manufactured product. Thus, heretofore, the manufacture of file drawers using conventional, channel-guided follow blocks has required the follow block to be placed in position in the drawer cavity before the second of the two sidewalls is secured in position. A consequence of this requirement is that the final painting of the file drawer takes place after assembly of the follow block in the drawer. The presence of the follow block of the drawer cavity greatly complicates the painting process, and results in a high rate of rejection of the painted products, adding significantly to the overall cost of manufacture.

Pursuant to the present invention, a novel and improved form of file drawer follow block is provided, which is not only less expensive in the first instance than the conventional follow block, but more importantly can be installed in the file drawer after completion of assembly of the drawer and after the painting has been completed. By enabling the file drawer to be painted before installation of the follow block, extraordinary savings can be realized in the reduction of product rejection, and overall product quality is desirably improved.

Pursuant to the invention, a follow block is inexpensively produced by injection molding techniques, in the form of a flat panel member of an open-grid-like construction. At opposite sides of the panel member, there are integral, molded guide bars, which project longitudinally from the panel member, advantageously principally in the forward direction. The spacing between the guide bar is greater than the spacing between the principal sidewall planes of the file drawer but appropriate to be received within longitudinally extending guide channels conventionally formed in the file drawer sidewall panels.

The injection molded follow block unit is constructed of a material, such as polypropylene, having a degree of elasticity, allowing the guide bar elements to be flexed laterally and then returned to their normal orientation, projecting longitudinally, more or less at right angles to the plane of the follow block. Installation of the new follow block, after assembly and painting of the file drawer, is accommodated by inserting the follow block into the file drawer cavity oriented at a substantial angle (e.g. 45° to its normal transverse orientation). The leading end extremity of one guide bar is inserted in the guide channel at one side, and the trailing end extremity of the guide bar at the opposite side is inserted in the opposite guide channel. Thereafter, the follow block panel is forcibly rotated to its normal position, extending across the body of the file drawer at right angles. During this rotating process, the projecting portion or portions of the integral guide bars are deflected laterally inward as necessary to allow the follow block to be properly oriented within the drawer. Once the normal orientation is achieved, the deflected guide bars return elastically to normal configuration, and the follow block is effectively self-retaining in such orientation by the relative rigidity by the guide bar members. While the follow block may be forcibly and intentionally removed from the drawer, if desired, it is self-retaining in operative position within the drawer, for normal purposes.

In accordance with a specific aspect of the invention, the follow block is designed and constructed in a particularly advantageous manner to accommodate injection molding thereof on an economical basis, without requiring unusually high pressure equipment or the like. To this end, the principal panel portion of the follow block is comprised of a plurality of diagonally disposed and intersecting stringer elements, circumscribed by a peripheral border element. A stiffening runner extends across the entire width of the panel, at the back thereof, and joins integrally with the respective guide bar elements at each side of the panel. In addition, the stiffening runner also advantageously intersects with the various diagonal stringer elements at points of intersection thereof. The stiffening runner thus serves not only in a functional capacity in the finished device, but also provides for a highly efficient flow of plastic material during the injection molding process.

For a more complete understanding of the above and other features and advantages of the invention, reference should be made to the following detailed description of a preferred embodiment of the invention and to the accompanying drawings.

DESCRIPTION OF THE PREFERRED EMBODIMENT

Figure 1:
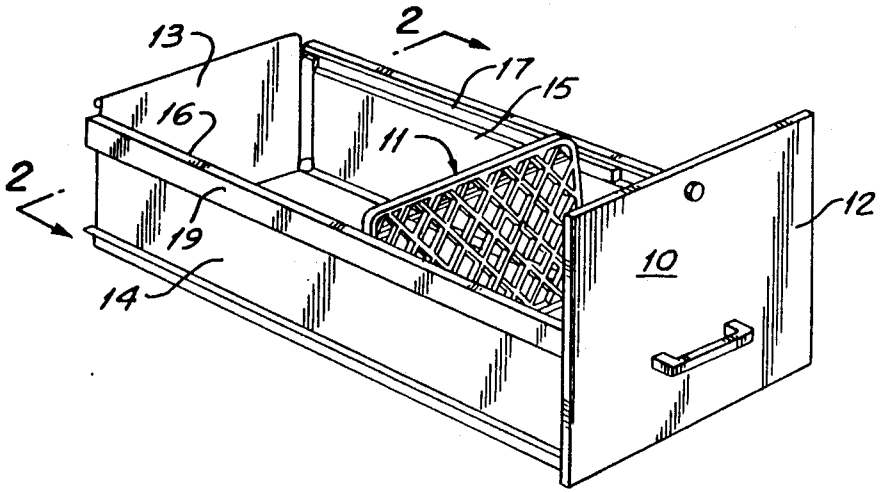
FIG. 1 is a top perspective view of a file drawer incorporating the improved injection molding follow block arrangement of the invention.
Figure 7:
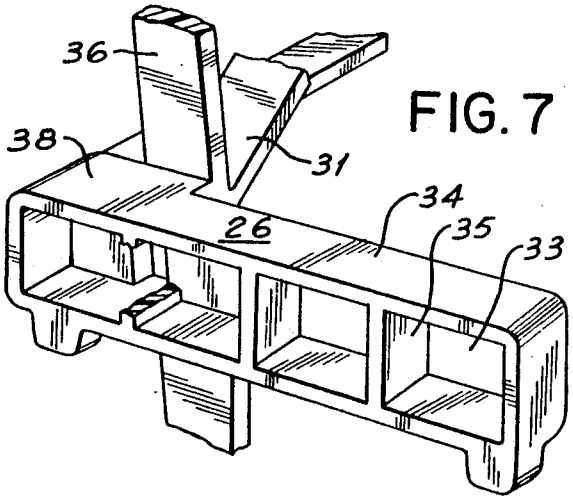
FIG. 7 is an enlarged, fragmentary perspective view showing details of construction of the guide bar elements incorporated in the follow block structure.

Referring now to the drawings, and initially to FIG. 1 thereof, the reference numeral 10 designates generally a typical file drawer construction utilizing a longitudinally adjustable follow block 11. The file drawer 10 conventionally includes front and back walls 12, 13 and opposite, vertical sidewalls 14, 15.

Figure 2:
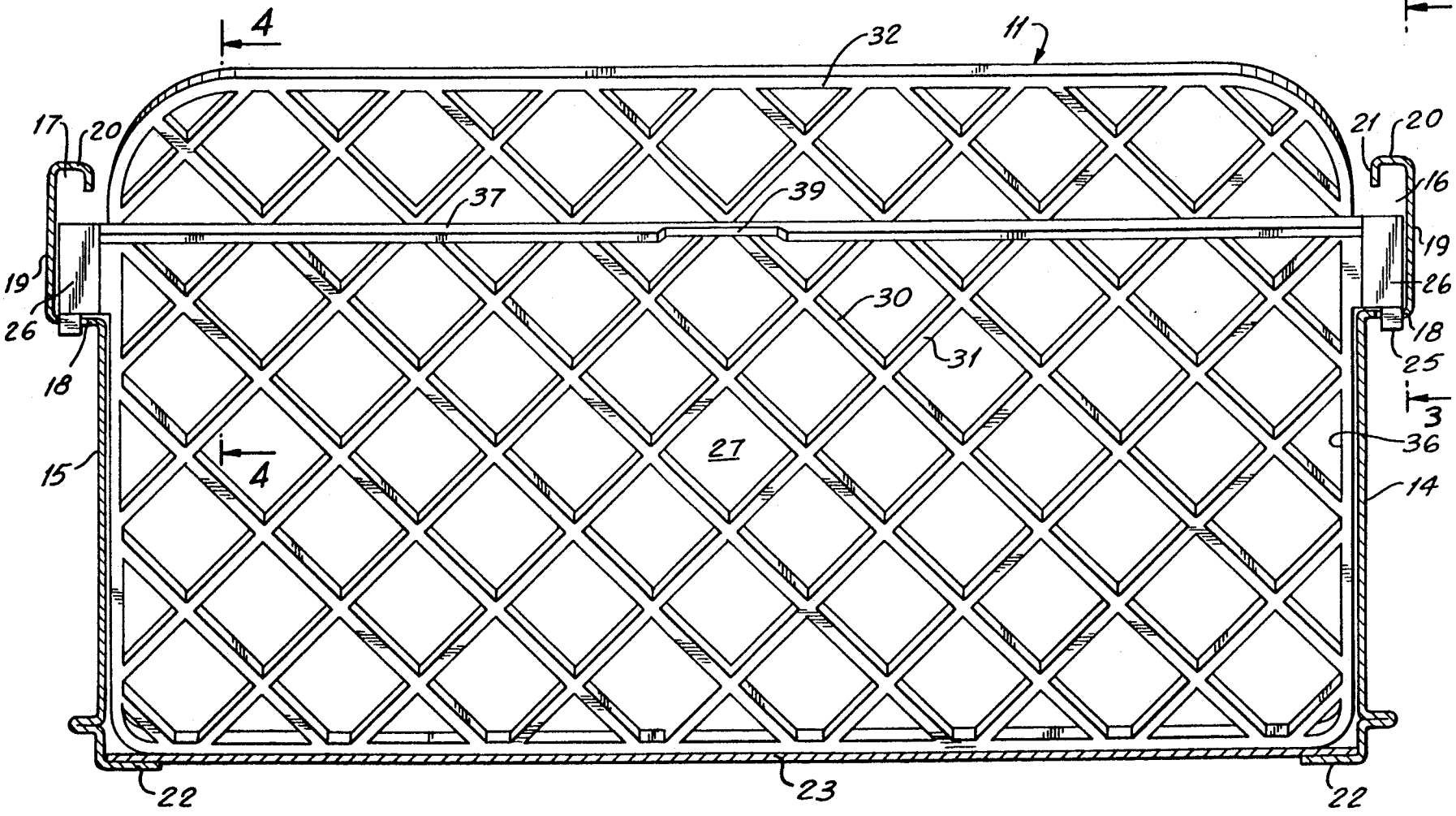
FIG. 2 is an enlarged cross sectional view as taken generally on line 2—2 of FIG. 1.

The style of file drawer construction contemplated by the invention is illustrated in somewhat more detail in the cross sectional illustration of FIG. 2. As there shown, the two sidewalls 14, 15 are provided near their upper edges with recessed, longitudinally extending guide channels 16, 17 formed by bending of the sheet material of the wall to provide channel bottom walls 18, channel sidewalls 19 and channel top walls 20. In the illustrated construction, the upper extremity of the sheet metal is provided with a downwardly directed flange 21 for additional strength and to provide a smooth exposed edge. As is evident in FIG. 2, the guide channels 16, 17 are recessed outwardly with respect to the principal planes of the sidewalls 14, 15.

In a file drawer of typical construction, the sidewalls 14, 15 may be provided with inwardly extending bottom flanges 22, which are secured to the opposite side margins of a sidewall panel 23 by suitable means, typically spot welding.

Figures 3, 4, 5, 6:
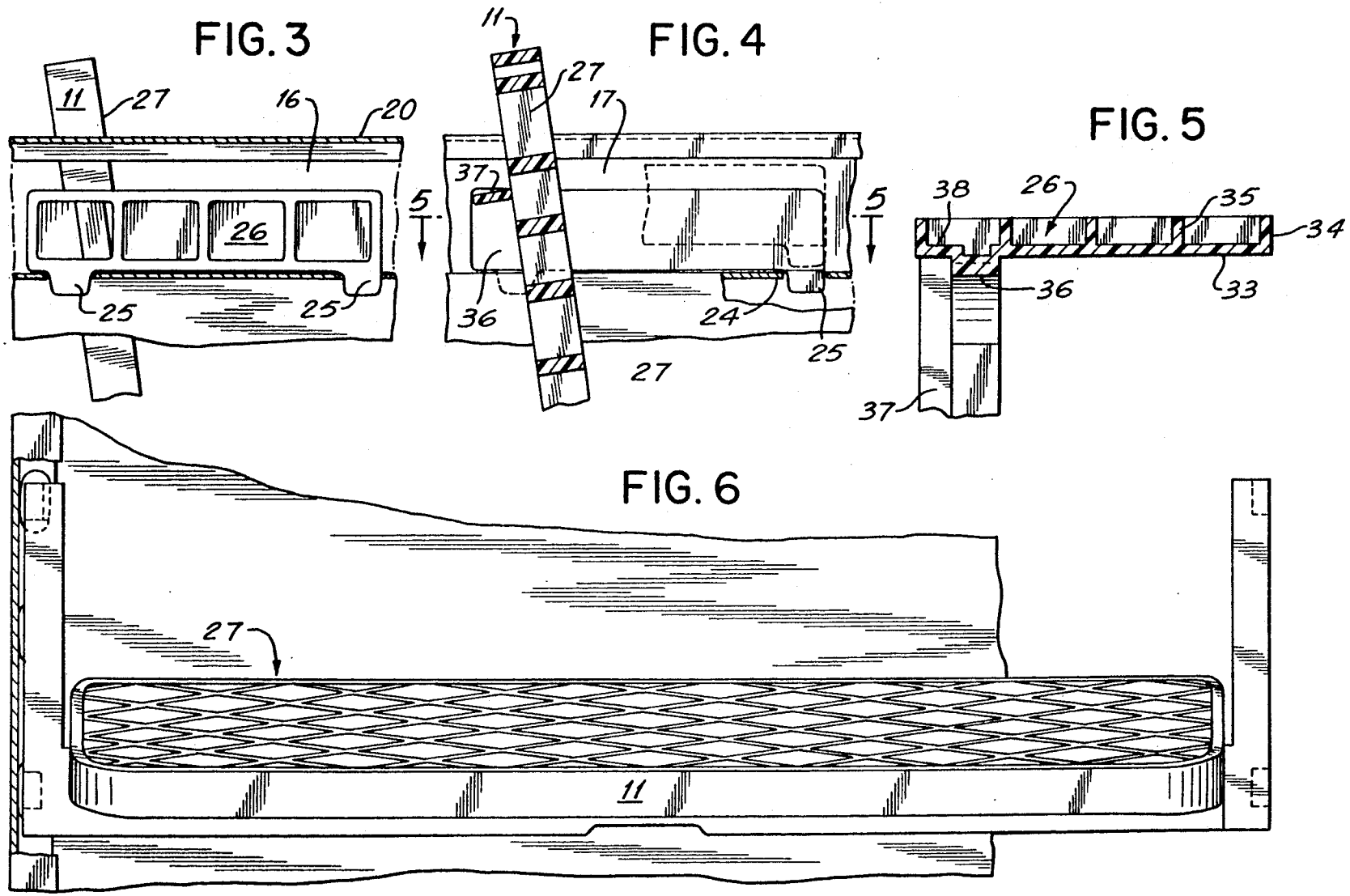
FIGS. 3 and 4 are cross sectional views as taken generally on lines 3—3, 4—4 respectively of FIG. 2.
FIG. 5 is a cross sectional view as taken generally on line 5—5 of FIG. 4.
FIG. 6 is a fragmentary top plan view, partly in section and with parts broken away of the file drawer assembly of FIG. 1.

In a conventional file drawer and follow block assembly of the general type illustrated, the guide channel bottom walls 18 are provided with a series of uniformly spaced openings 24 along their full length, which are arranged to receive locating lugs 25 (see FIG. 3, for example) projecting downwardly from longitudinally extending guide bar means 26 mounted at each lateral edge of a panel member 27 constituting the main body of the follow block 11. Repositioning of the follow block is accommodated by lifting the block, to withdraw the lugs 25 from the openings 24, and then sliding the block longitudinally in the drawer to align the lugs 25 with a different set of openings. The height of the channels 16, 17 is sufficiently greater than the height of the guide bars 26 to accommodate this degree of lifting, as reflected in FIG. 4, for example.

In a conventional file drawer, with a conventional follow block arrangement, the follow block is physically locked into its assembled relation in the file drawer, by reason of the fact that the guide bars 26 are "captured" within the guide channels 16, 17. This is evident in FIGS. 2 and 6, for example. Accordingly, it has been necessary, in the past, to install the follow block in its guide channels, before completing the assembly of the file drawer 10, as by installing one of the sidewalls 14, 15 or the back wall 13 after installation of the follow block. Inasmuch as the walls 13–15 customarily are assembled using spot welding techniques, for example, final painting of the drawers necessarily is performed after the assembly is completed, and thus after installation of the follow block 11. This has been the source of great difficulty in the past, because the presence of the follow block in the drawer seriously complicates the spray painting process. Indeed, the spray painting procedure has been compromised to a point that an excessively high rate of product rejection has been experienced at this stage of manufacture. As will be readily apparent, product rejection at this stage of the manufacturing process represents a very significant economical loss.

Pursuant to the invention, a novel and improved follow block arrangement is provided, wherein the file drawer 10 may be fully assembled, welded and painted before the follow block is installed. This not only greatly simplifies the manufacturing procedure, but more importantly eliminates the major source of product rejection in that the spray painting operation may proceed without having to work around the installed follow block. The painting operation can thus be completed much more rapidly and with much better quality of the end result.

Pursuant to the invention, the follow block 11 is produced by injection molding of a suitable plastic material, preferentially polypropylene. The follow block includes a generally planar panel portion 27, which is actually an open grill structure comprised of a plurality of diagonally extending, intersecting stringer elements 30, 31. In an advantageous embodiment of the invention, in which the typical dimensions of the follow block may be on the order of 12 inches in width and 6 ½ inches in height, the diagonal stringers may be spaced apart a distance of approximately one inch, and disposed at an angle of about 45° to the horizontal. The diagonal stringers may have a typical thickness of about 0.10 inch and a thickness of about 0.50 inch, providing a desirable balance between strength and low projected frontal area. A circumscribing peripheral border element 32 extends around the entire periphery of the follow block, joining integrally with the ends of the various diagonal stringers to provide a smooth, solid peripheral edge.

As reflected in FIG. 2, for example, the lateral width of the panel portion 27 of the follow block is just slightly smaller than the internal width of the file drawer, as defined by the principal planes of the vertical sidewalls 14, 15.

Integrally joined to the side edge extremities of the panel portion 27, are guide bars 26, which are arranged to be received in the guide channels 16, 17 and thus are oriented to extend longitudinally with respect to the guide channels. In the illustrated construction, the panel portion 27 of the follow block desirably is oriented at a slight angle to the vertical, for example, about 8°, so that the respective guide bars 26 are disposed parallel to each other and at an angle of, for example, 82° with respect to the principal plane of the panel portion 27.

The guide bars 26 are of considerably greater length than height, in order to impart a desired degree of stability and support to the follow block panel portion 27. In one advantageous embodiment of the invention, the guide bars may be approximately 3 ½ inches in length and, for example, about ¾ inch in height. In an embodiment of these proportions, the guide bars may have a thickness on the order of ⅜ of an inch. Advantageously, however, the guide bars are of a cored construction, defined by a vertical inner wall 33 integral with a peripheral wall 34 of rectangular outline. Partition walls 35 extend vertically, at an integral of about ⅜ of an inch, and are integrally joined with the peripheral wall 34 and the inner wall 33, providing a guide bar structure which is relatively lightweight, utilizing a relatively modest amount of plastic material, possessing adequate strength for the support and guidance of the follow block panel, and yet at the same time having a desired degree of lateral flexibility, as will be further described. The guide bars 26 are integrally joined to the side edges 36 of the peripheral stringer 32. The positioning of the guide bar 26 at each side is such that a substantial portion, for example about 2 ½ inches, projects from the plane of the panel portion 27. Desirably, the bars project in a forward direction, so as not to interfere with the positioning of the follow block close to the back wall of the file drawer. The arrangement is such that there is a substantial cantilevered portion of the guide bars 26 projecting forwardly from the follow block panel portion 27.

In accordance with one aspect of the invention, a strengthening runner 37 extends across the entire back of the panel portion 27, from one edge extremity to the other, joining integrally at its end extremity with short rearwardly projecting portions 38 of the guide bar elements 26. The strengthening runner serves a plurality of purposes in the structure of the invention. Typically, in a device of the proportions previously described, the strengthening runner may have a width of about ⅜ of an inch and a thickness of about 0.10 inch. Structurally, in addition to providing increased strength and rigidity to the flat panel portion 27 of the follow block, the strengthening runner 37 also provides a convenient facility for gripping and lifting the follow block, for repositioning within the file drawer.

An additional significant function of the strengthening runner 37 is in the distribution of the injected plastic material to the various diagonally extending stringers 30, 31 and to the respective guide bars 26 at each end. In this respect, the guide bars join integrally with the end extremities of the strengthening runner. For this purpose, the positioning of the guide bars 26 advantageously is such that a portion 38 thereof projects rearwardly from the back face of the panel portion 27 a distance sufficient to accommodate joining integrally with the ends of the laterally extending runner 37. In the specifically illustrated embodiment of the invention, it is contemplated that, in the injection molding process, molten plastic material will be injected at the center portion 39 of the runner. The material flows laterally along the runner and into all of the intersecting diagonal stringers 30, 31, from which material quickly flows throughout the structure of the panel portion 27. The material flowing to the ends of the runner 37 flows into the portions of the mold cavity defining the guide bars 26.

Figure 8:
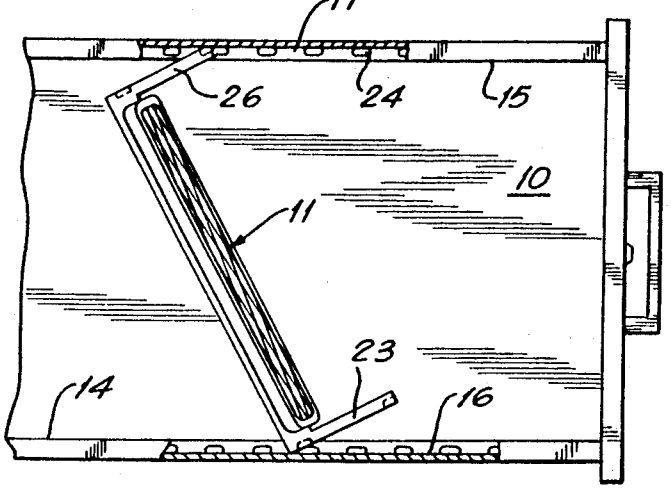
FIGS. 8 and 9 are sequential views, illustrating the manner of assembly of the new follow block structure together with the file drawer, after assembly of the latter.
Figure 9:
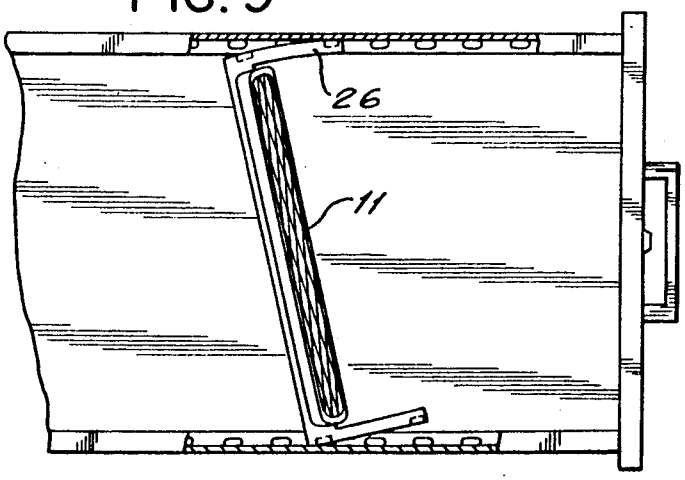

The manner of assembly of the molded follow block with the completed file drawer 10 is reflected in FIGS. 8 and 9 of the drawing. Initially, the follow block 11 is placed into the drawer cavity at a sufficient angle to the longitudinal axis thereof to allow the follow block 11 to clear the respective sidewalls 14, 15. The follow block is then progressively rotated toward a position at right angles to the longitudinal axis of the file drawer. As this rotary reorientation progresses, the forward end extremity of one of the guide bars enters the guide channel at one side, while the rearward projecting portion of the opposite guide bar enters the guide channel at the opposite side of the drawer. Continued rotating pressure on the follow block 11 causes the first-mentioned guide bar to be deflected inwardly as much as necessary to allow the follow block to assume its normal position in the drawer. This procedure is reflected in FIG. 9, for example. When the follow block reaches its normal position, at right angles to the longitudinal axis of the drawer, the two guide bar portions 26 at opposite sides of the follow block are effectively physically locked in the guide channels 16, 17, as is evident in FIG. 2. The follow block can, of course, be removed from the drawer by a forcible twisting motion, effectively the reverse of the operations required for installation. However, during normal usage, the follow block is effectively detained in the guide channels 16, 17.

Longitudinal adjustment of the follow block within the file drawer is accomplished in the usual manner, by lifting the follow block sufficiently to withdraw the spaced guide bar lugs 25 from the locator openings 24 provided in the bottom walls of the guide channels. This operation, in itself conventional, is facilitated with the follow block of the invention, by the location of the strengthening runner 37, which provides a convenient element for gripping of the block by the fingers, to lift the follow block for repositioning.

The follow block arrangement of the invention enables significant economies in the manufacture of adjustable file drawer assemblies by accommodating installation of the follow block after assembly and painting of the basic drawer unit. Not only is the painting operation itself greatly simplified and expedited, but quality is improved and the product rejection rate is significantly reduced.

In addition to the foregoing, the molded plastic follow block provides a desirable and advantageous construction, which is in itself economical to manufacture, lightweight, rigid and quiet.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. An adjustable follow block for use in combination with a file drawer having spaced-apart vertical side walls, longitudinally extending recessed guide channels extending lengthwise in each of said side walls intermediate the top and bottom edges thereof, and follow block positioning means associated with said guide channels, which comprises (a) a molded plastic panel member of a width to be received within said file drawer between said vertical side walls and of a height suitable to serve as a follow block for items stored in said file drawer forwardly of said panel member, (b) a pair of longitudinally extending guide bars integral with said panel member and mounted at the opposite side extremities thereof, (c) said guide bars being spaced apart a distance greater than the space between said vertical side walls whereby said guide bars can be received within and confined in said guide channels for longitudinal movement therein, (d) said guide bars being of a length greater than the height of said guide channels and having portions extending longitudinally from the plane of said panel member, (e) the longitudinally projecting portions of said guide bars being laterally deflectable with respect to said panel member to a sufficient degree to accommodate installation of said follow block in said file drawer by a twisting motion from a starting position disposed at an acute angle to the side walls of said drawer to an installed position at right angles to said side walls.

2. An adjustable follow block according to claim 1, further characterized by (a) said guide channels being formed with top, bottom and side walls for confining said guide bars, (b) said guide channel bottom walls having spaced-apart openings therein, (c) said guide bars having integral, spaced-apart, downwardly projecting positioning lugs formed thereon adapted to be received in said openings for positioning said follow block in said file drawer.

3. An adjustable follow block according to claim 1, further characterized by, (a) said guide bars extending principally in the forward direction from said panel member.

4. An adjustable follow block according to claim 1, further characterized by, (a) said panel member having a principal plane and being of an open grid construction comprised of intersecting stringer elements, extending diagonally from top to bottom in opposite diagonal directions, and a peripheral border circumscribing the edges of said panel member and joined integrally with the ends of said diagonal stringer elements, (b) said stringer elements being of greater width than thickness and having their principal planes disposed at right angles to the principal plane of said panel member and defining spaced-apart front and back planes of said panel member, (c) a stiffening runner element extending laterally across the back of said panel member and projecting rearwardly from the back plane of said panel member, (d) said stiffening runner integrally joining at each lateral end thereof with portions of said guide bars.

5. An adjustable follow block according to claim 4, further characterized by, (a) said guide bars extending rearwardly of the back plane of said panel member a distance approximating the width of said stiffening runner, and projecting forward of said panel member a substantially greater distance.

6. An adjustable follow block according to claim 4, further characterized by, (a) said stiffening runner integrally intersecting with the back edges of each of the diagonal stringer elements which extend from a level above said runner to a level below said runner.

7. An adjustable follow block according to claim 6, further characterized by, (a) said stiffening runner integrally intersecting with said diagonal stringer elements at points of intersection thereof.

8. An adjustable follow block for use in combination with a file drawer having spaced-apart vertical side walls, longitudinally extending guide channel means extending lengthwise in each of said side walls intermediate the top and bottom edges thereof, and follow block positioning means associated with said guide channel means, which comprises (a) a molded plastic panel member of a width to be received within said file drawer between said vertical side walls and of a height suitable to serve as a follow block for items stored in said file drawer forwardly of said panel member, (b) a pair of longitudinally extending guide bars integral with said panel member and mounted at the opposite side extremities thereof, (c) said guide bars being spaced apart a distance whereby said guide bars can be received within and confined in said guide channel means for longitudinal movement therein, (d) said guide bars being of a length greater than the height of said guide channel means and having portions extending longitudinally from the plane of said panel member, (e) the longitudinally projecting portions of said guide bars being laterally deflectable laterally inward with respect to said panel member to a sufficient degree to accommodate installation of said follow block in said file drawer by a twisting motion from a starting position disposed at an acute angle to the side walls of said drawer to an installed position at right angles to said side walls.

9. An adjustable follow block according to claim 8, further characterized by (a) an integral stiffening runner extending laterally across the back face of said panel member and joining integrally with said guide bars at each side of said panel member.

10. An adjustable follow block according to claim 8, further characterized by (a) said panel member comprising a plurality of diagonally extending, intersecting stringer elements, (b) said stringer elements being of greater width than thickness, and (c) the thickness of said panel member being defined by the width of said stringer elements.

* * * * *